US006978578B2

(12) United States Patent
Givoni

(10) Patent No.: US 6,978,578 B2
(45) Date of Patent: Dec. 27, 2005

(54) PANEL UNIT OF CONTROLLABLE LIGHT TRANSMISSIVITY

(75) Inventor: Shaul Givoni, Upper Galilee (IL)

(73) Assignee: Dan-Pal, Upper Galilee (IL)

( * ) Notice: Subject to any disclaimer, the term of this patent is extended or adjusted under 35 U.S.C. 154(b) by 478 days.

(21) Appl. No.: 10/252,107

(22) Filed: Sep. 23, 2002

(65) Prior Publication Data

US 2003/0056448 A1 Mar. 27, 2003

(30) Foreign Application Priority Data

Sep. 25, 2001 (IL) ..... 145619

(51) Int. Cl.[7] ..... E04D 13/18; E06B 3/096

(52) U.S. Cl. ..... 52/173.3; 52/201; 49/82.1; 160/236

(58) Field of Search ..... 52/171.1, 173.3, 52/204.593, 473, 563, 574, 786.1, 800.12, 52/200, 201; 49/74.1, 82.1, 403, 64; 160/236, 160/107; 126/425, 702

(56) References Cited

U.S. PATENT DOCUMENTS 1,520,232 A * 12/1924 French ..... 109/16
3,012,294 A * 12/1961 Waldor ..... 52/207
3,348,459 A * 10/1967 Harvey ..... 404/35
4,111,183 A * 9/1978 Haberthier ..... 126/629
4,427,048 A * 1/1984 Osaka et al. ..... 160/107
4,435,919 A * 3/1984 Poisson ..... 49/63
4,475,536 A * 10/1984 Dame ..... 126/585
4,573,300 A * 3/1986 Bezner ..... 52/563
4,658,806 A * 4/1987 Boozer ..... 126/703
4,773,733 A * 9/1988 Murphy et al. ..... 359/593
4,998,395 A * 3/1991 Bezner ..... 52/563
5,052,150 A * 10/1991 Chen ..... 49/82.1
5,600,920 A * 2/1997 Roy ..... 49/64
6,015,002 A * 1/2000 Biro et al. ..... 428/121
6,085,825 A * 7/2000 Swink et al. ..... 160/188
6,134,842 A * 10/2000 Cheng et al. ..... 52/171.1
6,314,680 B1 * 11/2001 Buckwalter et al. ..... 49/82.1

FOREIGN PATENT DOCUMENTS

WO WO 99/66149 12/1999

OTHER PUBLICATIONS

European Search Report corresponding to EP 02 25 6633, dated Dec. 5, 2002.
Figure 15 from U.S. Appl. No. 09/719,676 based on PCT/IL99/00326.

* cited by examiner

*Primary Examiner*—Winnie Yip
(74) *Attorney, Agent, or Firm*—Smith, Gambrell & Russell, LLP

(57) ABSTRACT

The invention provides a panel unit of controllable radiation transmissivity, including a housing constituted by a front, radiation-receiving panel and a rear panel, the panels being spaced apart and connected to one another by connecting means; a plurality of rotatable radiation-blocking members disposed between the front panel and the rear panel, the members being rotatable from one angular position in which the radiation-blocking members are adapted to substantially block the passage of light through the panel unit, to a selectable plurality of other angular positions in which the radiation-blocking members are adapted to provide a plurality of differing radiation transmissivities; characterized in that first guiding surfaces for the rotatable radiation-blocking members are disposed inside of, and extend across, the housing.

21 Claims, 8 Drawing Sheets

PANEL UNIT OF CONTROLLABLE LIGHT TRANSMISSIVITY

FIELD OF THE INVENTION

The present invention relates to a panel unit of controllable radiation transmissivity for the construction of walls, roofs, awnings, skylights, windows, and the like.

BACKGROUND OF THE INVENTION

Israel Patent Application No. 124,949 teaches a panel which comprises a plurality of rotatable members having an opaque surface, which members, when rotated, are adapted, in at least one angular position, to substantially block the passage of light through the panel, and, in a plurality of other, selectable angular positions, to provide a plurality of differing radiation transmissivities.

While the above-mentioned panel does indeed provide a steplessly adjustable light transmissivity, it has certain disadvantages, inasmuch as the rotatable light-blocking members are accommodated in an array of tubular cells of relatively large size and wall thickness, that add to the costs of these panels.

DISCLOSURE OF THE INVENTION

It is an object of the present invention to ameliorate the disadvantages of the prior art light-blocking panels and to provide a panel unit having controllable radiation transmissivity facilitating substantially the complete blocking of radiation.

The invention therefore provides a panel unit of controllable radiation transmissivity, comprising a housing constituted by a front, radiation-receiving panel and a rear panel, said panels being spaced apart and connected to one another by connecting means; a plurality of rotatable radiation-blocking members disposed between said front panel and said rear panel, said members being rotatable from one angular position in which said radiation-blocking members are adapted to substantially block the passage of light through said panel unit, to a selectable plurality of other angular positions in which said radiation-blocking members are adapted to provide a plurality of differing radiation transmissivities; characterized in that first guiding surfaces for said rotatable radiation-blocking members are disposed inside of, and extend across, said housing.

BRIEF DESCRIPTION OF THE DRAWINGS

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIG. 1 is an exploded view of the panel unit according to the present invention;

FIG. 2 is an end view of the panel unit of FIG. 1, without the drive mechanism and its housing;

FIG. 3 is a perspective view, in partial cross-section and to a larger scale, of the rotatable radiation-blocking member;

FIGS. 4–6 illustrate variants of the radiation-blocking member;

FIG. 7 represents the general shape and location of the lower cross-members;

Figure 8:
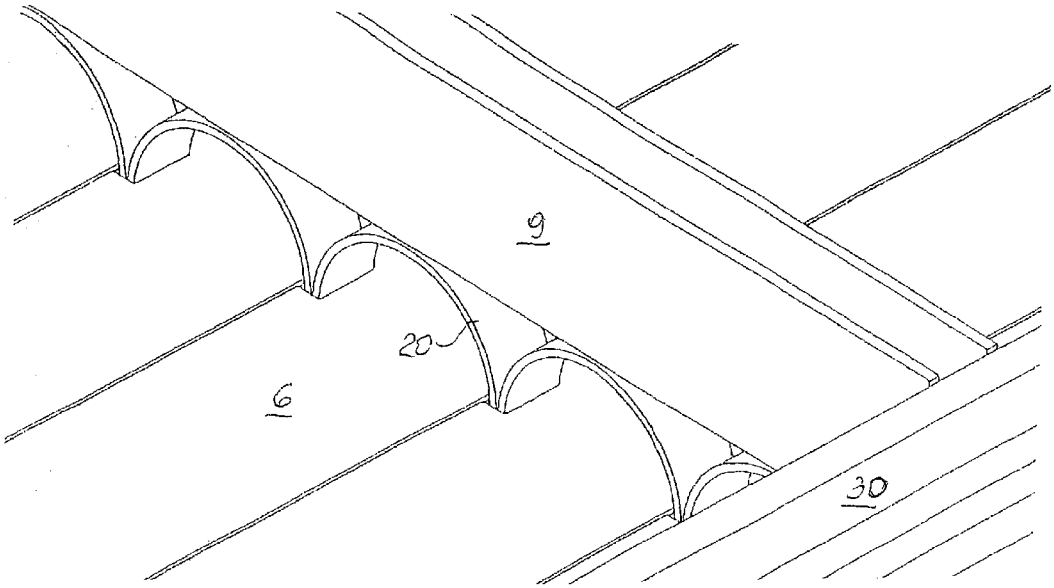
Figure 9:
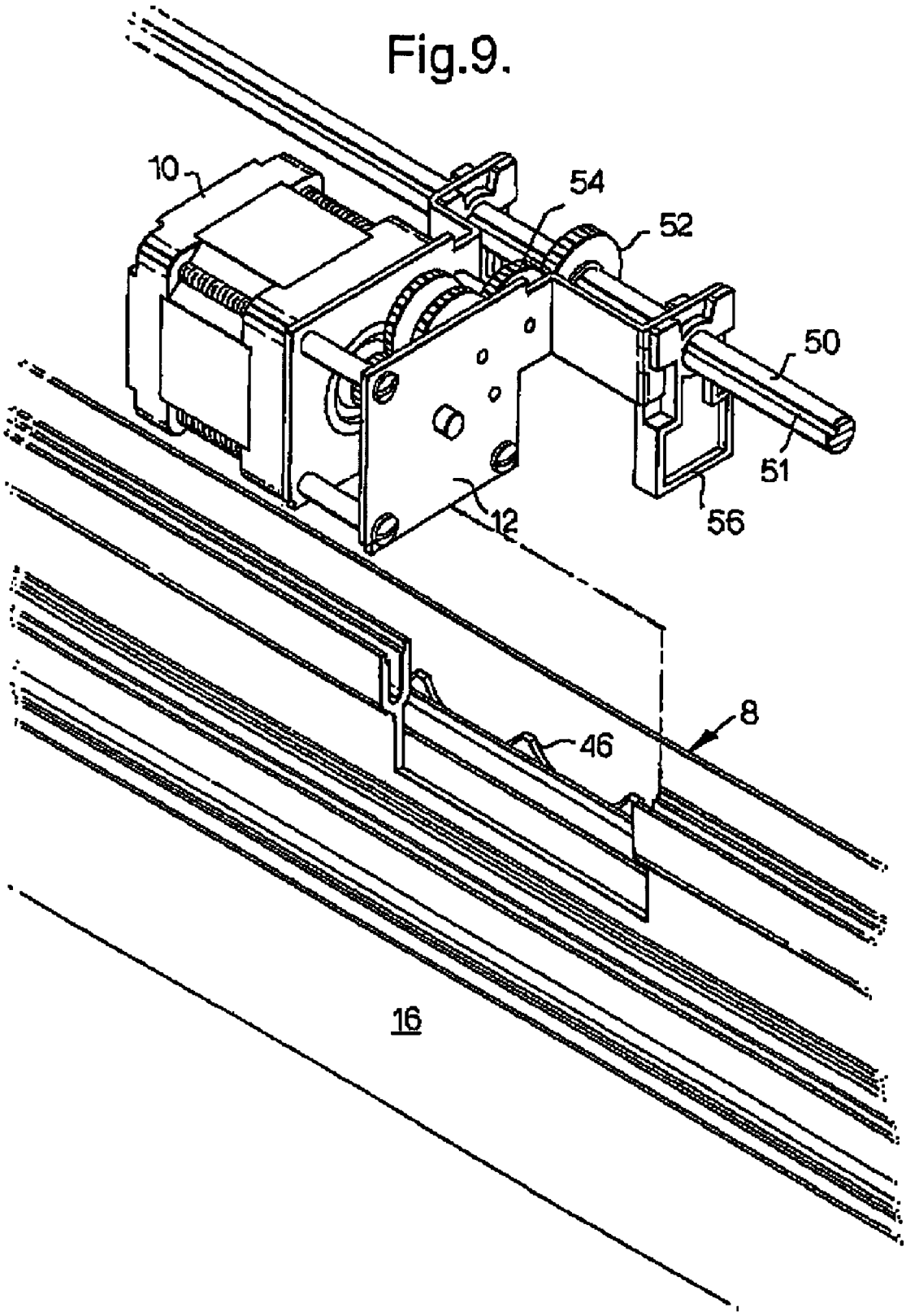
Figure 10:
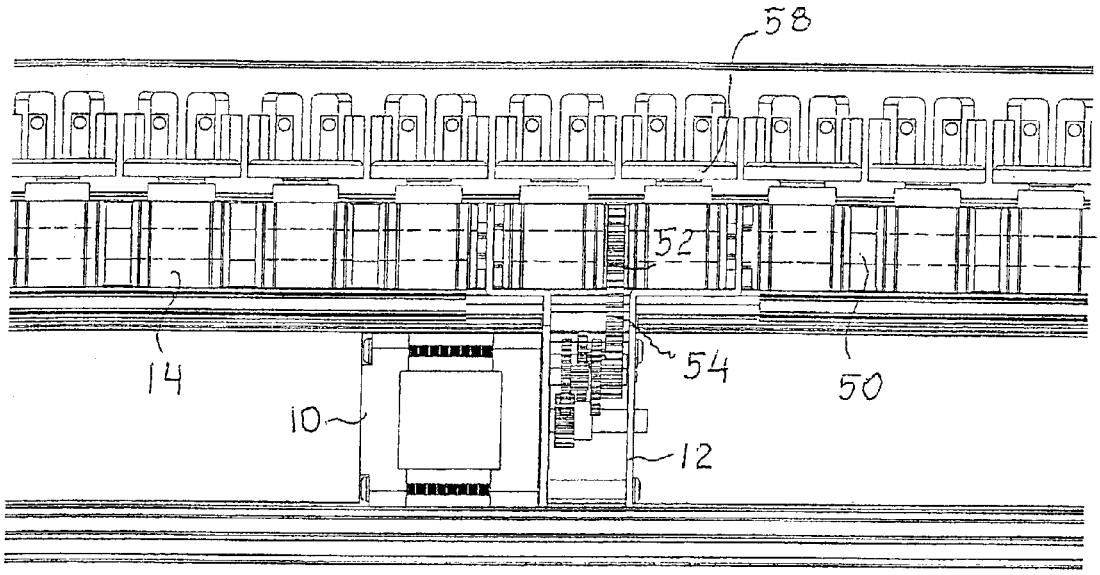
Figure 11:
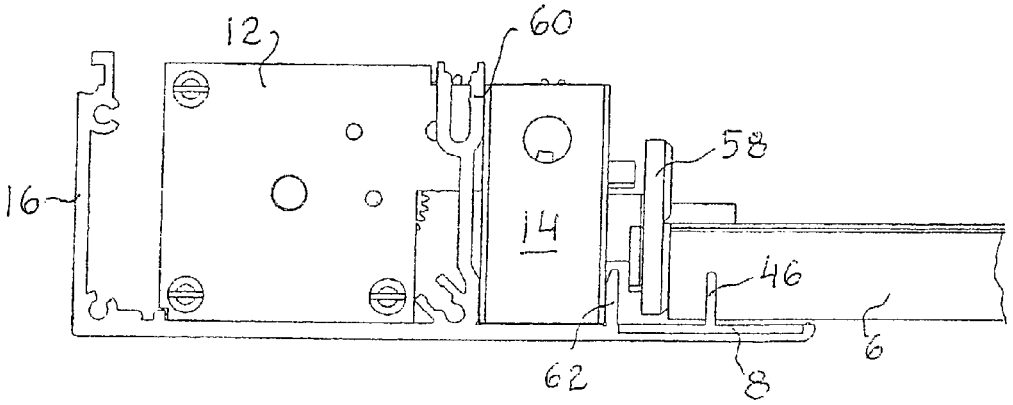
Figure 12:
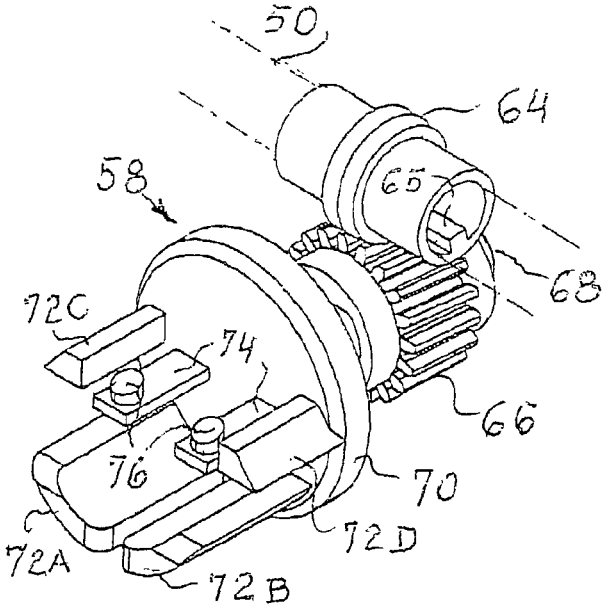
Figure 13:
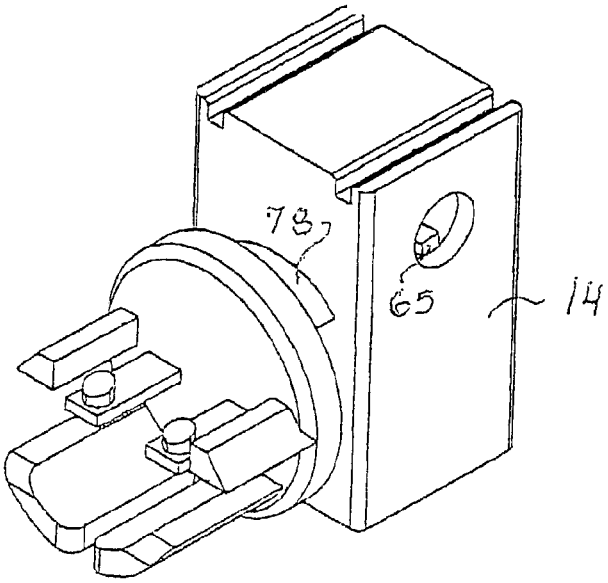

FIG. 8 indicates the shape and location of the upper cross-member to a larger scale;

FIG. 9 is an exploded view of part of the drive mechanism;

FIG. 10 is a partial top view of the cross-member accommodating the drive mechanism;

FIG. 11 is a side view of the components shown in FIG. 10;

FIG. 12 illustrates the components of the gearbox of FIGS. 10 and 11;

FIG. 13 illustrates the fully encased gearbox, and

Figure 14:
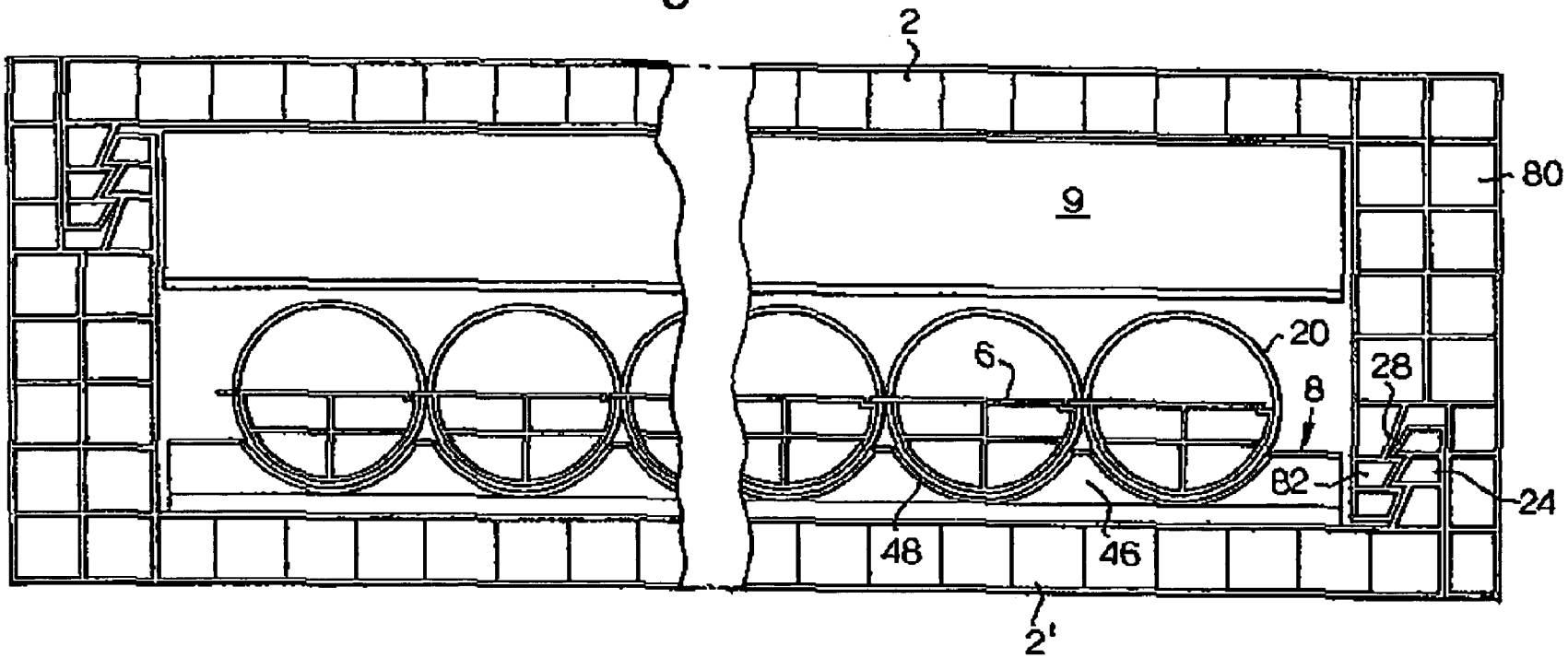

FIG. 14 is an end view of another embodiment of a panel unit according to the invention.

DETAILED DESCRIPTION

Figure 1:
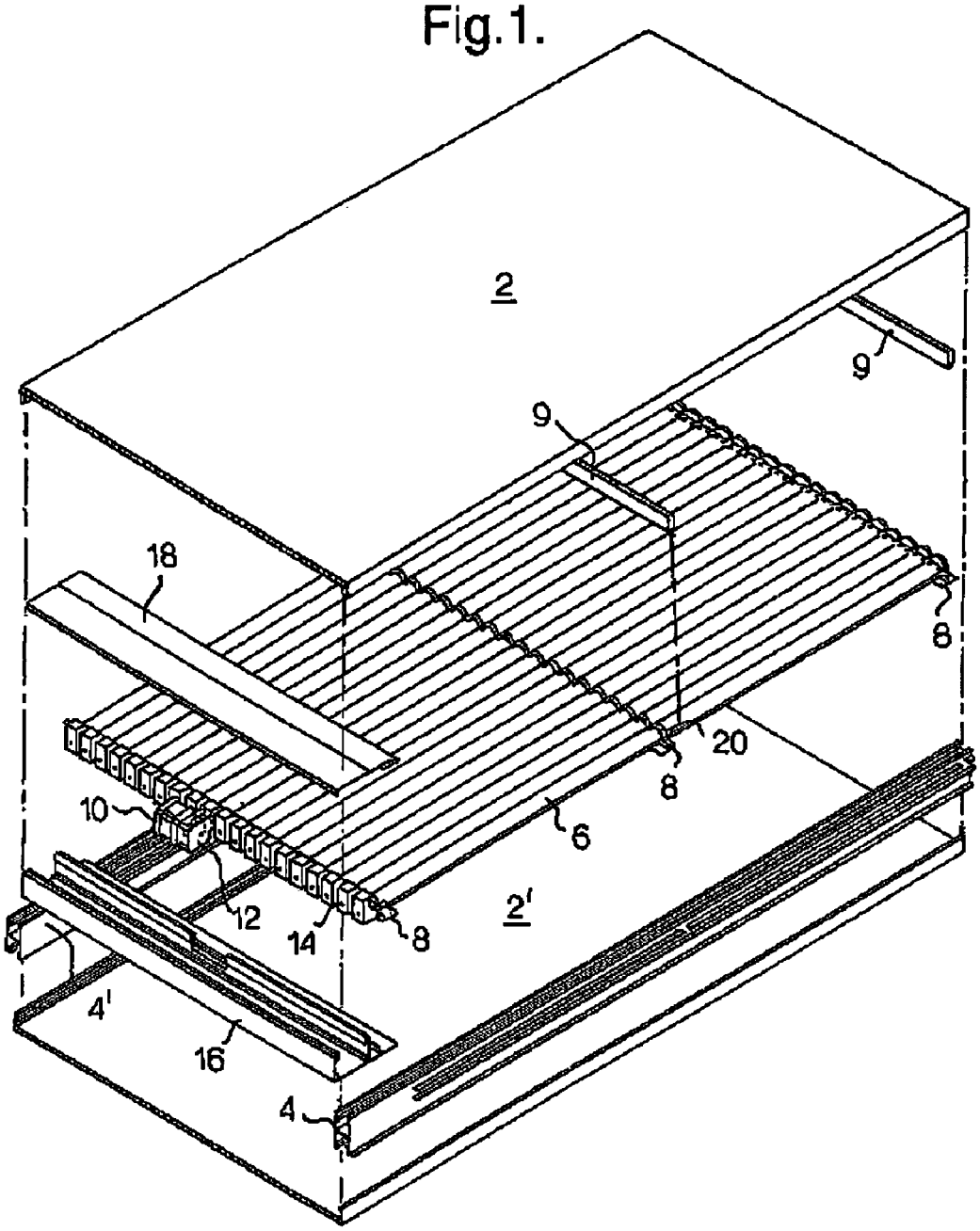

Referring now to the drawings, FIG. 1 illustrates a radiation-receiving front panel 2, a rear panel 2' and two lateral connecting members 4, 4' which, in assembly, constitute the housing of the panel unit according to the present invention. These components are seen to better effect in FIG. 2 and will be explained in detail further below.

Further seen in FIG. 1 is a battery of rotatable radiation-blocking members 6 disposed between front panel 2 and rear panel 2'. This central component of the panel unit is shown to a larger scale in FIGS. 2 and 3, and will be discussed in conjunction with these Figures. The radiation-blocking members 6 are supported by lower cross-members 8 of which, in the panel of FIG. 1, there are three, resting, in assembly, on rear panel 2'. The number of these cross-members obviously depends on the actual length of the panel unit. Also seen are upper cross-members 9, in assembly, substantially co-planar with, but above, the lower cross-members 8. Both the upper and lower cross-members will be discussed further below in conjunction with FIGS. 2, 4 and 5. Cross-members 8 and 9 are shown to better effect in FIGS. 4 and 5, respectively.

FIG. 1 also illustrates the drive mechanism, which includes an electric motor 10 coupled to a reduction gear 12 that drives the radiation-blocking members 6 via gearboxes 14, each member having its own gearbox 14. Cross-member 16, advantageously made of an aluminum extrusion, serves as housing for the drive mechanism and also closes off the front end of the panel unit. Cross-member 16, as well as the drive mechanism, is covered by a cover plate 18.

Supporting rings 20, their purpose and the manner of their mounting, are discussed below in conjunction with FIGS. 2 and 3.

Figure 2:
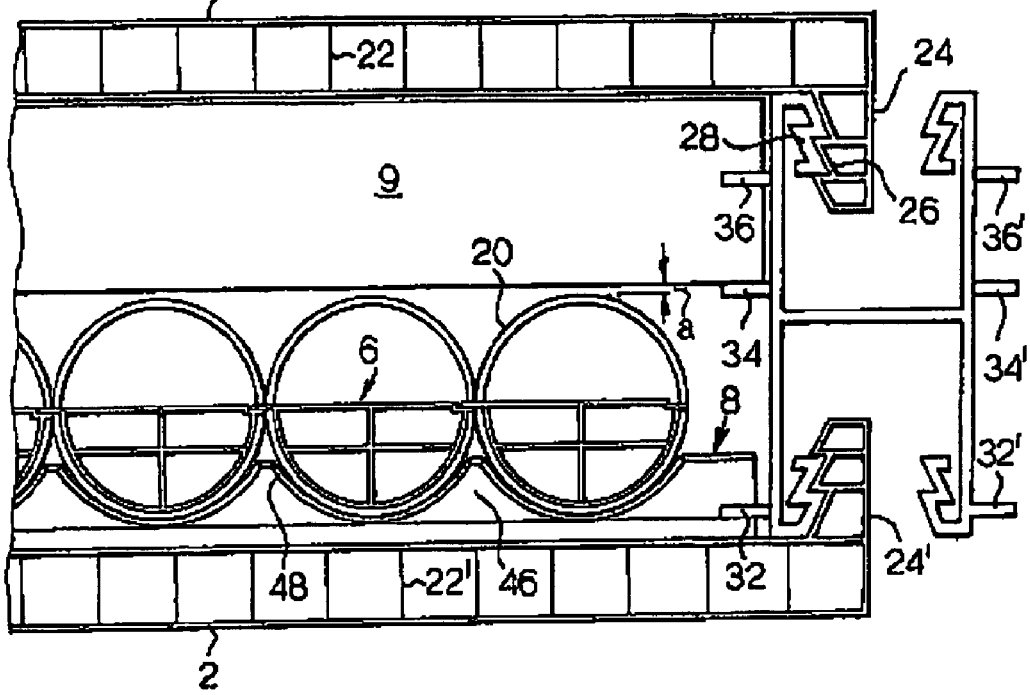

FIG. 2 is a fragmented end view of the assembled panel unit, but without the drive mechanism and its housing. There are seen front panel 2 and rear panel 2', two substantially identical plastic extrusions, advantageously made of polycarbonate. Each panel consists of two spaced-apart plane sheets interconnected by ribs 22, 22', which provide mechanical strength and define air spaces for thermal and acoustic insulation. Each panel is also provided with flanges 24 on each of its lateral edges. The inside surface of each flange 24 is comprised of sawtooth-like barbs 26, which are adapted to engage and lock against similarly shaped barbs 28 in a lateral, substantially H-shaped, connecting member 30. The latter is advantageously made of an aluminum extrusion and connects not only the front and rear panels of a single panel unit, but also, as is clearly shown, constitutes the connecting member of adjacent panel units. Member 30 is furthermore provided with a number of rail-like ledges 32, 34, 36 and 32', 34', 36', the purpose of which will become apparent further below.

It will be appreciated that, the above notwithstanding, the panels could also be single-plane sheets or even glass sheets, and that the panels could be connected at their front and rear ends, rather than laterally.

Inside the space defined by front panel 2, rear panel 2' and connecting members 30 (FIG. 2), there are located a plurality of rotatable, radiation-blocking members 6, supporting rings 20 for members 6, lower cross-member 8 and upper cross-member 9.

Figure 3:
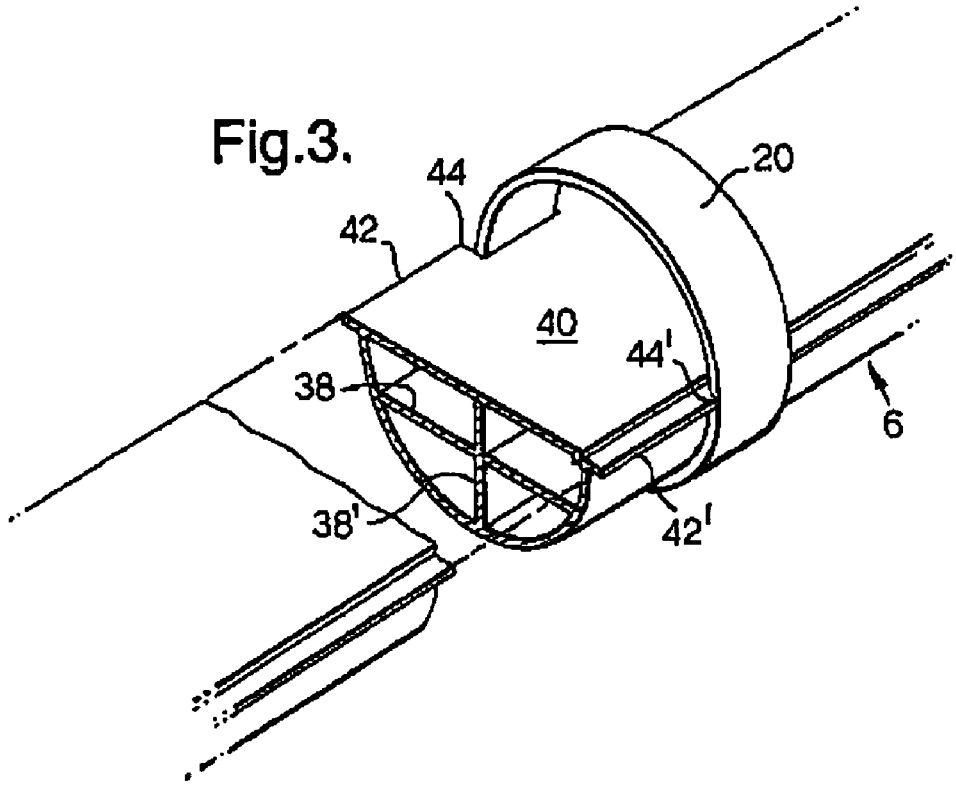

Radiation-blocking member 6, shown to better effect in FIG. 3, is a tubular, generally transparent, plastic extrusion with a profile advantageously reinforced by horizontal and vertical ribs 38, 38' respectively, and is approximately semi-cylindrical, subtending an angle of about 180°. The top surface of member 6 is substantially plane and is rendered opaque (hereinafter "opaque plane 40") by such known means as painting, coating with an opaque film, or the provision of an opaque plastic layer applied by coextrusion. Edges 42, 42' of member 6 extend beyond the largest width of the semi-circular profile, edge 42 being coplanar with top surface 40, while edge 42' is stepped down to a depth equaling the thickness of protruding edge 42, so that, in the blocking position represented in FIG. 2, the two edges overlap and also provide abutment surfaces.

Supporting rings 20 are made of a plastic material and are thin enough to be elastically deformable, having an inside diameter substantially identical with the outside diameter of the semi-circular profile, and are sprung into pairs of recesses 44, 44' provided in edges 42, 42' at appropriate distances, depending on the total length of the panel unit.

Rings 20 are in turn supported by lower cross-member 8, which has the form of an extruded plastic T-profile that rests on rear panel 2' and is held in position by ledges 32, 32' of connecting members 4. The vertical web 46 of cross-member 8 is provided with preferably cylindrical recesses 48, of a curvature slightly smaller than the outside curvature of rings 20, so that the latter have only line contact with recesses 48.

Figure 4:
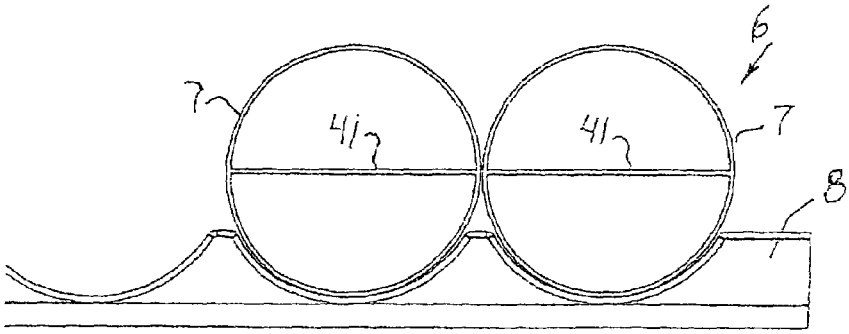
Figure 5:
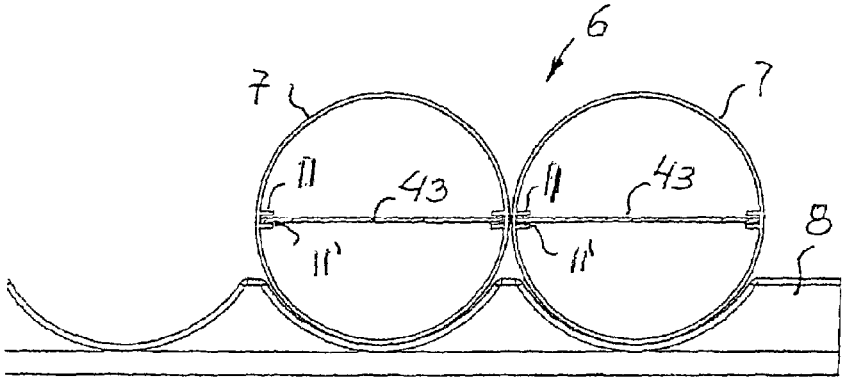
Figure 6:
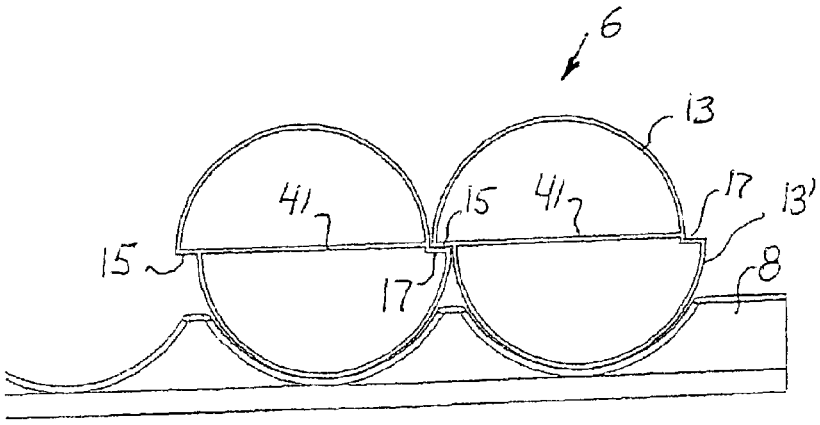

Further envisaged variants of radiation-blocking member 6 are illustrated in FIGS. 4–6. FIG. 4 shows a first of such variants, in the form of a tubular, fully cylindrical portion 7 consisting of a transparent plastic extrusion and comprising a diametrical, substantially opaque planar partition 41, co-extruded with the cylindrical portion 7, but made of an opaque plastic.

FIG. 5 illustrates another cylindrical variant of radiation-blocking member 6, in which the transparent, tubular, cylindrical portion 7 is provided with two diametrically opposite pairs of inward-pointing, short flanges 11, 11', defining between the partners of each pair a slot, into which is slid an opaque strip 43, either of plastic or metal.

FIG. 6 illustrates a further variant of radiation-blocking member 6, seen to consist of two transparent, substantially half-cylindrical portions 13, 13' and a substantially planar, diametrical, opaque partition 41. The two half-cylindrical portions 13, 13' are laterally mutually offset, producing a left overhang 15 and a right overhang 17. It is seen that the right overhang 17 is stepped down, so that in the blocking position shown in FIG. 6, overhangs 15 and 17 overlap and also constitute abutment surfaces, with all opaque surfaces being rendered co-planar.

The variants of FIGS. 4–6 do not require the use of rings 20 and are therefore in direct contact with recesses 48 in cross-member 8.

Another solution could be in the form of a flat, elongated strip with a zebra-like cross-section, looking as if cross-hatched, in which transparent stripes alternate with opaque stripes. Such a strip could offer maximal transmissivity at a certain angle of incidence, and substantial opacity at another angle of incidence.

Figure 7:
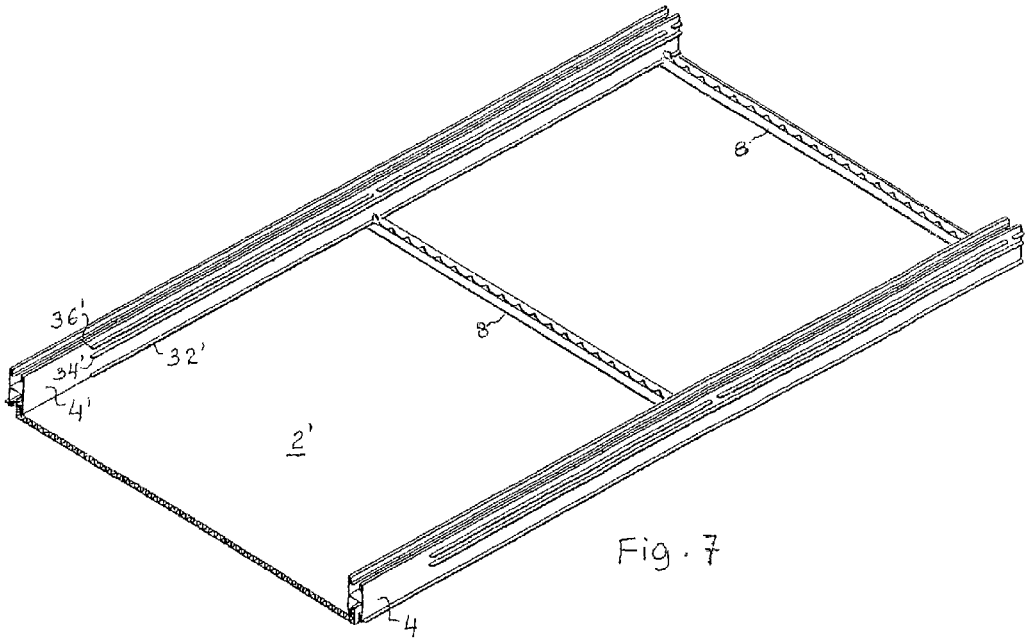

FIG. 7 illustrates the general shape and location of lower cross-member 8 with respect to lower panel 2'.

Upper cross-member 9, seen in FIG. 2 and, to better effect, in the perspective drawing of FIG. 8, has the task of substantially maintaining the contact between radiation-blocking members 6 and their rings 20 with the curved recesses of lower cross-member 8, but without causing additional friction when members 6 are rotated. This is achieved by providing a small gap a between rings 20 and the lower surface of upper cross-member 9, as clearly seen in FIG. 2. Cross-member 9, a U-profile advantageously produced by extrusion (see also FIG. 8) is located above rings 20 and is held in this position by ledges 34, 36 of connecting member 4.

As mentioned above, FIG. 2 represents the state of maximum opacity of the panel unit. Radiation transmissivity increases when, relating to FIG. 2, radiation-blocking members 6 are rotated in the clockwise sense, with transmissivity becoming maximal when the opaque plane 40 (FIG. 3) is rotated into a position where it offers the least surface area to the sun or the brightest part of the sky.

FIG. 9 represents an exploded view of part of the drive mechanism, including cross-member 16 which accommodates the entire mechanism, motor 10, advantageously a stepping motor, manually and/or electronically controlled, depending upon light conditions sensed by a photodetector. Further seen are reduction gear 12 and slotted shaft 50, extending over the entire width of the unit. A gear 52, meshing with the output gear 54 of reduction gear 12, is keyed to shaft 50. Also seen are two posts 56, whereby the motor-gearbox unit is attached to cross-member 16. Partly shown is the first of cross-members 8, which defines the respective positions of gearboxes 14 (FIG. 10).

Shown in the top view of FIG. 10 are gearboxes 14, which, as will be seen in FIGS. 12 and 13, are in fact worm gears, all of which are keyed to and are driven by shaft 50. The worm wheels are keyed to coupling members 58, being the output members of gearboxes 14. Coupling members 58 are provided with shaped projections, part of which fit the spaces created by reinforcing ribs 38, 38' of radiation-blocking members 6, thus constituting the drivers of members 6.

In the side view of FIG. 11, there are shown extruded cross-member 16, reduction gear 12, a second vertical member 60 of the extrusion, a low rail 62 that is an integral part of the extrusion, the first of the three cross-members 8 that, in the embodiment of FIG. 1, support the radiation-blocking members 6, and coupling member 58.

Gearbox 14, to be discussed in greater detail below with reference to FIGS. 12 and 13, is positioned between vertical member 60 and rail 62, but has one degree of freedom in translation in a direction perpendicular to the paper, which enables it to align itself with radiation-blocking members 6, the positions of which are defined by the recesses in webs 46 of cross-member 8.

FIG. 12 illustrates the components accommodated in gearbox 14 of FIGS. 10 and 11, already defined as a worm gear. Worm 64 is keyed to shaft 50 by means of key 65, but has one degree of freedom in translation in the axial direction of shaft 50. Worm 64 meshes with worm wheel 66, which, in turn, is keyed to axle 68 of coupling member 58; thus, rotation of shaft 50 will produce a rotation (at reduced speed) of coupling member 58.

Axle 68 ends in a flange 70, from which project drive fingers 72A, 72B, 72C and 72D. Of these fingers, 72A and 72B fit, and thus can be slipped into, the two spaces produced in radiation-blocking members 6 below horizontal reinforcing rib 38 (FIG. 3), and fingers 72C and 72D come to rest on opaque plane 40 of member 6.

Further seen are two elastic fingers 74 which, at their ends, carry cupped projections 76. These projections are designed to be snapped into two holes (not shown) of appropriate size and location near the end of each radiation-blocking member 6, thus constituting a positive link between members 6 and coupling members 58.

FIG. 13 represents the fully encased gearbox 14. There is also seen an annular segment 78, integral with the casing and subtending a defined angle which is configured to cooperate with a similar segment (not shown) integral with flange 70, which segments constitute a stop and also serve as reference points for the proper assembly of the panel unit.

FIG. 14 illustrates another embodiment of the invention which dispenses with the separate, H-shaped connecting members 30 of FIG. 2 by providing each of the panels with a relatively short, slender flange 24, such as shown in FIG. 2, and a longer and heavier flange 80, the lower end of which is configured to constitute a connecting member in the form of a female counterpart to flange 24. The sawtooth-like barbs 28 of flange 24 are adapted to engage and interlock with similarly shaped barbs 82 within the end portion of flange 80.

While it would, of course, be possible to provide one of panels 2, 2' with two flanges 24 and the other one with two flanges 80, the advantage of the design illustrated in FIG. 14 resides in the fact that the same extruded profile can be used for front panel 2 and, simply turned around, also for rear panel 2'.

Cross members 8, 9 are fixedly attached to their respective panels, e.g., by cementing.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A panel unit of controllable radiation transmissivity, comprising:

a housing constituted by a front, radiation-receiving panel and a rear panel, said panels being spaced apart and connected to one another by connecting means;

a plurality of rotatable tubular radiation-blocking members disposed between said front panel and said rear panel, said members being rotatable from one angular position in which said radiation-blocking members are adapted to substantially block the passage of light through said panel unit to a selectable plurality of other angular positions in which said radiation-blocking members are adapted to provide a plurality of differing radiation transmissivities; and lower cross members each having a plurality of guiding surfaces attaching and supporting said tubular rotatable radiation-blocking members and being disposed inside of, and extend across, said housing.

2. The panel unit as claimed in claim 1, wherein said guiding surfaces of said lower cross members have a rib portion provided with a plurality of adjacent recesses for supporting said rotatable radiation-blocking members.

3. The panel unit as claimed in claim 2, wherein said recesses have a substantially circular profile.

4. The panel unit as claimed in claim 2, further comprising upper cross-members disposed inside of, and extending across, said housing.

5. The panel unit as claimed in claim 4, wherein said upper cross-members extend with clearance above said ring-like members, designed to substantially maintain the contact between said radiation-blocking members in their ring-like members, with the recesses of said lower cross-members.

6. The panel unit as claimed in claim 1, wherein said tubular radiation-blocking member is a substantially half-cylindrical portion and a substantially planar portion.

7. The panel unit as claimed in claim 6, wherein said planar portion is substantially opaque, while said half-cylindrical portion is substantially transparent.

8. The panel unit as claimed in claim 6, wherein one edge of said radiation-blocking member is substantially co-planar with said planar portion, while the second edge is stepped down to a depth substantially equaling the thickness of said co-planar edge.

9. The panel unit as claimed in claim 6, wherein said ring-like members have an inside diameter substantially identical with the outside diameter of said half-cylindrical portion.

10. The panel unit as claimed in claim 1, wherein said radiation-blocking member is provided with at least one reinforcing rib.

11. The panel unit as claimed in claim 1, wherein said radiation-blocking member has two longitudinal edges.

12. The panel unit as claimed in claim 11, wherein said edges extend beyond the largest width of said half-cylindrical portion.

13. The panel unit as claimed in claim 11, wherein the longitudinal edges of said radiation-blocking member are provided with at least one pair of recesses, the recesses of said pair being located one opposite the other.

14. The panel unit as claimed in claim 13, wherein said radiation-blocking members are supported on said guiding surfaces via ring-like members sprung into said pair of recesses.

15. The panel unit as claimed in claim 1, wherein said tubular radiation-blocking member is a transparent, substantially cylindrical portion and an opaque, substantially planar diametrical portion co-extruded with said cylindrical portion.

16. The panel unit as claimed in claim 1, wherein said tubular radiation-blocking member is a transparent, substantially cylindrical portion provided with two diametrically opposite pairs of inward-pointing, short flanges defining, between the partners of each of said pairs, a slot for maintaining an opaque strip.

17. The panel unit as claimed in claim 1, wherein said radiation-blocking member consists of two transparent, substantially half-cylindrical portions and an opaque, substantially planar and diametrical partition co-extruded with said half-cylindrical portions, and wherein said two half-cylindrical portions are laterally mutually offset, producing an overhang on each of their lateral sides, one of which overhangs is stepped down.

18. The panel unit as claimed in claim 1, further comprising drive means including a drive shaft driven by an electric motor, in drive connection with a plurality of the worms of worm gears, the wheels of said worm gears being mounted on the input shaft of a coupling, the output side of which coupling is configured to enter and drive said radiation-blocking members.

19. The panel unit as claimed in claim 1, wherein said panels are provided at their longitudinal edges with flanges, at least one of the lateral surfaces of said flanges being provided with sawtooth-like barbs.

20. The panel unit as claimed in claim 1, wherein said connecting means are in the form of an H-shaped profile, the open ends of which constitute the femal counterparts to said flanges, being provided with sawtooth-like barbs adapted to engage and interlock with the barbs of said flanges.

21. The panel unit as claimed in claim 1, wherein both panels are provided with flanges having sawtooth-like barbs on at least one of their surfaces, said barbs on the flanges of one of said panels being configured to engage and interlock with the barbs on the flanges of the other one of said panels.

* * * * *